United States Patent [19]

Kaieda

[11] Patent Number: 4,812,878

[45] Date of Patent: Mar. 14, 1989

[54] CLEANING APPARATUS FOR ELECTROPHOTOGRAPHY

[75] Inventor: Shozo Kaieda, Nagano, Japan

[73] Assignee: Kentex Information Systems, Inc., Allendale, N.J.

[21] Appl. No.: 36,018

[22] Filed: Apr. 8, 1987

[30] Foreign Application Priority Data

Dec. 1, 1986 [JP] Japan ..... 61-266649

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 3,976,375 | 8/1976 | Kurita et al. | 355/14 |
| 4,426,151 | 1/1984 | Aguro et al. | 355/15 |
| 4,449,241 | 5/1984 | Nakayama | 355/15 X |
| 4,465,362 | 8/1984 | Tohma et al. | 355/15 |
| 4,469,434 | 9/1984 | Yamazaki et al. | 355/15 |
| 4,514,480 | 4/1985 | Wada et al. | 430/30 |
| 4,568,175 | 2/1986 | Inowa et al. | 355/15 |
| 4,571,070 | 2/1986 | Tomita | 355/15 |
| 4,576,468 | 3/1986 | Saito | 355/15 |

*Primary Examiner*—Fred L. Braun

*Attorney, Agent, or Firm*—Marmorek, Guttman & Rubenstein

[57] ABSTRACT

A cleaning apparatus for removing residual toner from a rotatable charge image retentive member, such as a photoconductive belt or drum, consists of an elastic cleaning blade on an elastic support. The elastic cleaning blade includes a resilient leg and an elastically deformable cleaning edge which projects outward from the leg and toward the image retentive member. The elastic cleaning blade is supported at a downstream position relative to the rotational direction of the image retentive member. The resilient leg is caused to curve away from the image retentive member while maintaining the cleaning edge in contact with the image retentive member as it rotates.

22 Claims, 3 Drawing Sheets

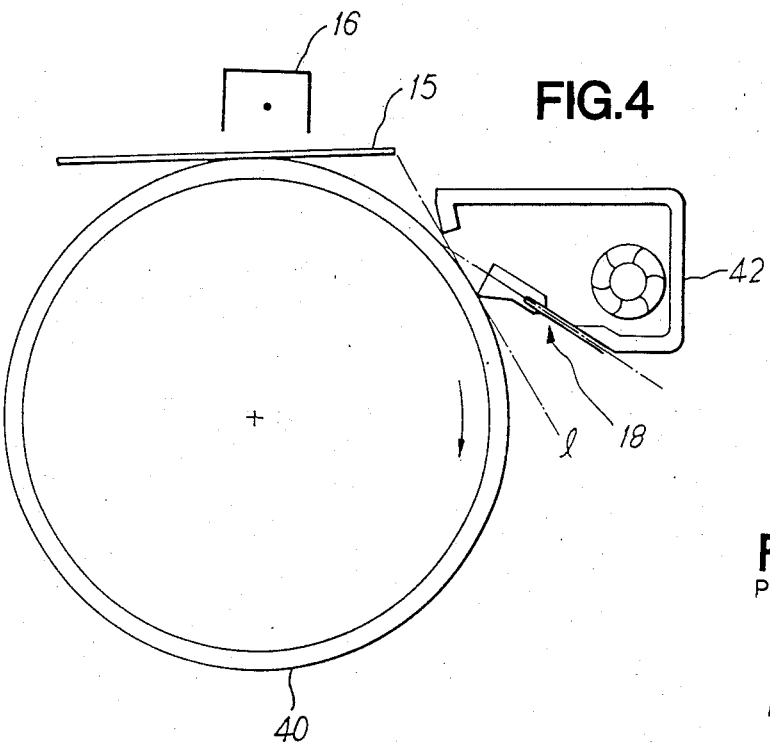
FIG.4
FIG.6
PRIOR ART
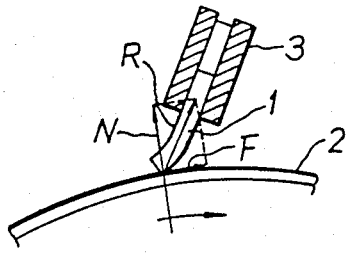
FIG.5a
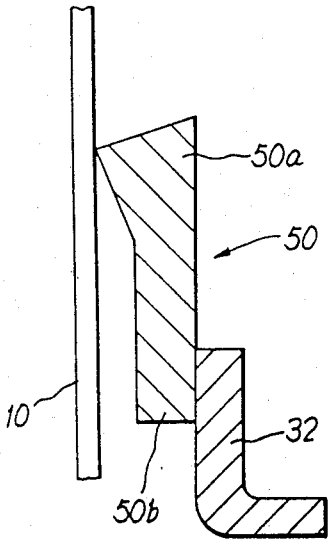
FIG.5b
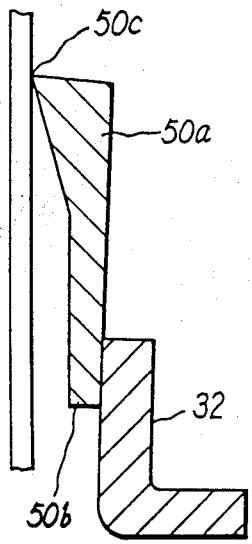

CLEANING APPARATUS FOR ELECTROPHOTOGRAPHY

BACKGROUND OF THE INVENTION (1) Field of the Invention:

The present invention relates to a cleaner apparatus for removing toners remaining on a charge image retentive member such as a photosensitive member.

(2) Related Art Statement:

Image-forming systems have been practically used, which form images on the charge image retentive members such as photosensitive member or insulating dielectric films through the formation of electrostatic latent images. According to such image-formign systems, the electrostatic latent image on the charge image retentive member is converted to a toner image and the toner image thus obtained is transferred onto a recording medium such as an ordinary paper to form a visible image. On the other hand, toners remaining on the charge image retentive member is removed by a cleaner unit, and then an electrostatic latent image is formed on the cleaned charge image retentive member again, thereby enabling repeated formation of images. However, since the toner image cannot be completely transferred onto the recording medium in the image-forming system, development of cleaner units which can remove the toners remaining on the charge image retentive member after the transfer have been strongly demanded.

Japanese patent publication No. 50,34,340 discloses a cleaner unit for removing the toner remaining on the charge image retentive member. As shown in FIG. 6, this cleaner unit comprises a plate-like cleaning blade 1 made of a rubbery elastic material. A support holder supports a base portion of the cleaning blade 1 and pushes it against a photosensitive member such that the blade is curved in a direction in which the blade approaches the photosensitive member. Thereby, an edge of the blade is press contacted upon the surface of the photosensitive member by utilizing a resilient restoring force originating from the curving of the blade. When a frictional force of the running photosensitive member and a push force of the residual toner act upon the edge portion, the blade is further curved to approach the photosensitive member and the residual toner is removed by utilizing the resilient deflection due to the curving of the blade.

In the known cleaner unit mentioned above, it must be that the plate-like elastic rubber blade is pushed against the photosensitive member such that the central portion of the blade is curved to approach the photosensitive member and the edge portion is press contacted with the surface of the photosensitive member by utilizing the resilient restoring force caused by this curving and that an acting direction of a composed force between the press contact force and the frictional force is accurately coincided with the longitudinal direction of the curved blade. For this reason, when the blade is to be set, a press contact angle and a curved amount of the blade must be accurately determined relative to the photosensitive member. Consequently, the blade-setting operation unfavorably becomes troublesome.

Further, as the frictional force acts upon the blade, the blade functions to bite the running photosensitive member, with the result that the edge portion of the blade is more strongly press contacted with the photosensitive member. Accordingly, damages upon the photosensitive member becomes greater and its useful life becomes shorter due to abrasion of the photosensitive member. Owing to this, a release mechanism must be provided to free the press contact, when the system is stopped, for preventing damages upon the photosensitive member and the abrasion of the blade itself. This causes the inconvenience that the structure of the cleaner unit becomes complicated.

SUMMARY OF THE INVENTION

Therefore, an object of the present invention is to eliminate the above-mentioned problems encountered by the prior art cleaner unit.

More particularly, the object of the present invention is to provide a cleaner unit which can reliably remove a developer attached on various kinds of charge image retentive members including a photosensitive member by a relatively small press contact force and enables a cleaning blade to be relatively easily set.

According to the present invention, there is a provision of a cleaner unit for removing a residual toner by bringing a resilient blade member into contact with a residual toner-attached charge image retentive member which comprises a resilient leg portion made of an elastic material, the blade member which is formed in one end of this resilient leg portion and includes a resilient edge portion that projects toward the charge image retentive member out of a longitudinal axis of the resilient leg portion and has an edge adapted to be brought into contact with the charge image retentive member, and a supporting member that supports the other end portion of the resilient leg portion on a forward side as viewed in running direction of the charge image retentive member, wherein the resilient leg portion is curved in a direction deviating apart from the charge image retentive member when the resilient edge portion is brought into contact with the running charge image retentive member and the frictional force acts thereon.

According to the present invention, since the edge which constitutes a cleaning line upon contact with the surface of the charge image retentive member to which is attached the residual toner projects toward the charge image retentive member apart from the central axis of the resilient leg portion, the resilient leg portion is curved and displaced in a direction deviating from the charge image retentive member by the frictional force acting upon the edge, so that a resilient repulsion is stored mainly in the resilient leg portion by this curving and displacement. On the other hand, when the toner on the charge image retentive member contacts with the edge portion, a push force acts upon the blade in a running direction of the charge image retentive member. At this time, the resilient leg portion is further curved by the push force of the toner so that such a greater resilient repulsion as to repulse the residual toner substantially reversely to the running direction of the charge image retentive member is stored mainly in the resilient leg portion. The residual toner can be effectively scraped off from the surface of the charge image retentive member by this resilient repulsion.

These and other objects, advantages and features of the present invention will be appreciated upon reading of the following description of the invention when taken in conjunction with the attached drawings with the understanding that some modifications. Variations and changes of the same could be made by the skilled person in the art to which the invention the invention pertains without departing from the spirit of the invention or the scope of claims amended hereto.

BRIEF DESCRIPTION OF THE ATTACHED DRAWINGS

For a better understanding of the invention, reference is made to the attached drawings, wherein.

Figure 3B:
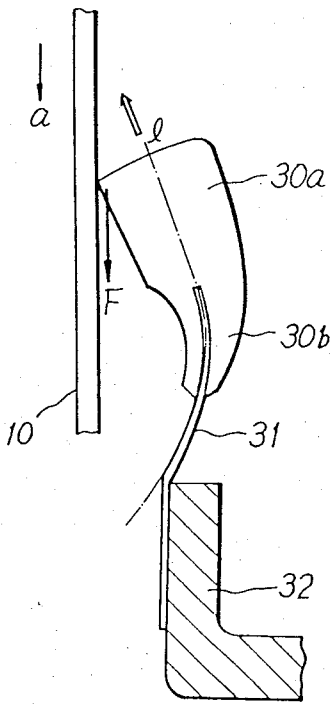
Figure 3A:
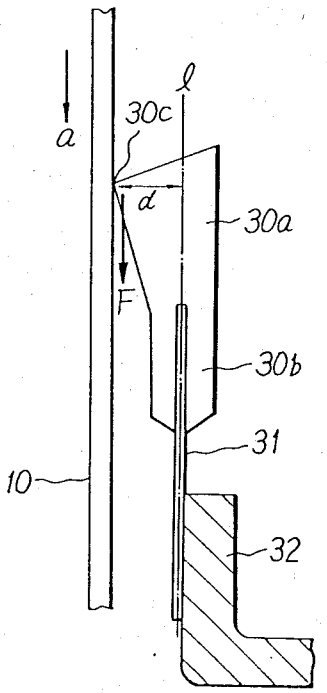

FIGS. 3*a* and 3*b* are diagrammatical views illustrating the state of a force acting upon the cleaning blade;

FIG. 4 is a diagrammatical view illustrating the construction of a modification of the cleaner unit according to the present invention;

FIGS. 5*a* and 5*b* are diagrammatically sectional views illustrating the constructions of further modifications of the cleaning blade according to the present invention; and FIG. 6 is a diagrammatical view illustrating the construction of a prior art cleaner unit.

DETAILED DESCRIPTION OF THE PREFERRED EMBODIMENTS OF THE PRESENT INVENTION

Figure 1:
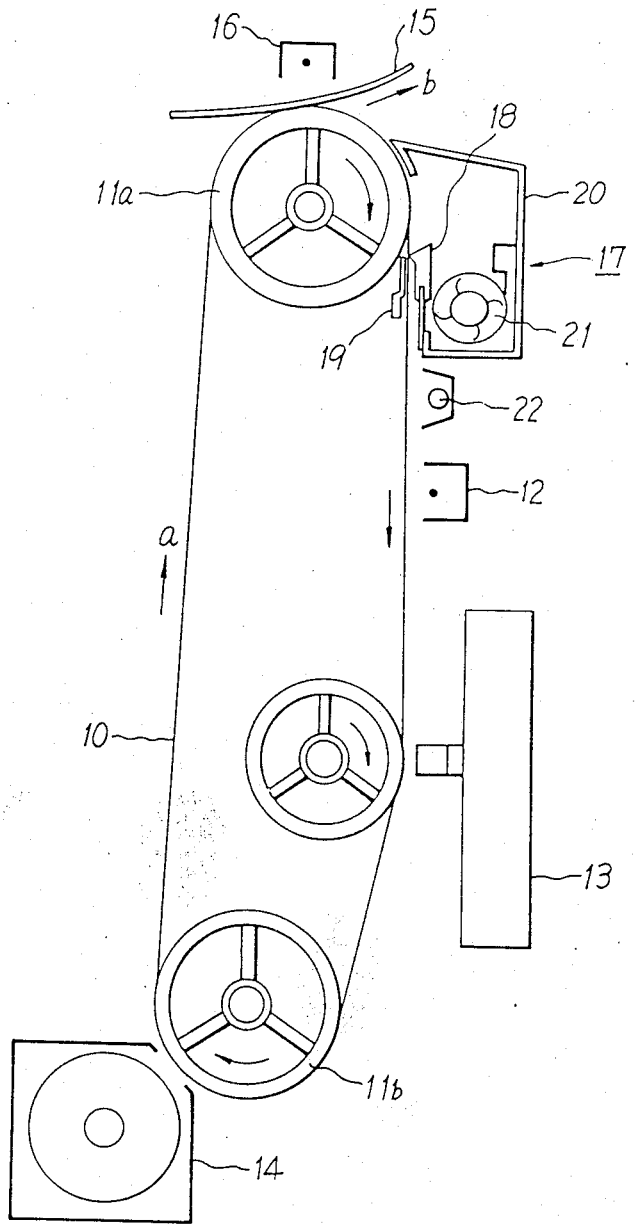
FIG. 1 is a diagrammatic view illustrating an embodiment of an image-forming unit of a printer system equipped with the cleaner unit according to the present invention.

In FIG. 1 is diagrammatically illustrated the construction of an embodiment of an image-reproduction unit of a printer system which is equipped with the cleaner unit according to the present invention. In this embodiment, a belt type photosensitive member having a predetermined recording width is used as the charge image retentive member. The photosensitive belt 10 is run in a direction of an arrow "a" extending between two drive rollers 11*a* and 11*b* which are vertically arranged opposite to each other. The photosensitive belt 10 is charged to a given potential voltage over its entire surface by means of a corona charger 12, after which the charged photosensitive belt 10 is exposed by an exposure unit 13, and an electrostatic latent image is formed on the photosensitive belt 10. The exposure unit 13 may be a light emitting diode array in which a number of light-emitting diodes are linearly arranged over the recording width (in a vertical direction with respect to a paper surface). The electrostatic latent image formed on the photosensitive belt 10 is moved to a developing station where a toner image is formed upon development of the latent image by a developer unit 14. Then, the thus formed toner image is moved to a transfer station where the toner image is transferred to a recording paper 15, which is fed in synchronization with the movement of the toner image, by means of a transferring charger 16 arranged behind the recording paper. After the transferring, the recording paper is carried in a directon of an arrow "b", and is discharged outside the printer in a facedown state through a fusing unit (not shown). On the other hadn, since the non-transferred toner remain on the surface of the photosensitive belt 10 having undergone the transferring step, the non-transferred toners are removed by means of a cleaner unit 17. The cleaner unit 17 comprises a cleaning blade 18 which extends over the recording width of the photosensitive belt 10. While a tip edge of the cleaning blade 18 is press contacted with the running photosensitive belt 10, a restraint plate 19 is arranged on the rear side of the photosensitive belt 10. By so constructing, the residual non-transferred toner is scraped off from the running photosensitive belt 10. The scraped toner is transferred sideward of the cleaner unit 17 by means of a screw roller 21 which is arranged in a housing 20. The charges retained on the toner-free photosensitive belt 10 are uniformly dissipated down to a predetermined potential by an erase lamp 22. Then, the image-reproducing operation is repeatedly performed. As mentioned above, since the transferring step is carried out at the vertical top portion of the image-reproduction unit, the recording paper is discharged in a face-down state through an almost linear passage after the transferring, thereby advantageously simplifying the transporting passage for the recording papers.

Figure 2:
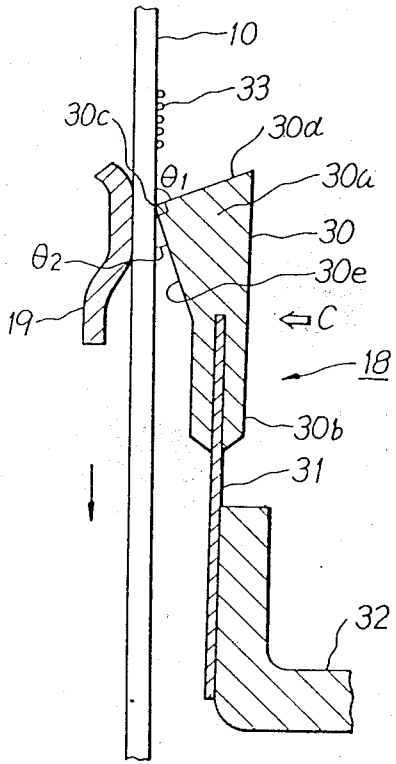
FIG. 2 is a diagrammatically sectional view illustrating the detailed construction of the cleaning blade in the present invention.

FIG. 2 is a sectional view illustrating the detailed construction of the cleanign blade. The cleaning blade 18 has an elastically deformable tip 30 extending over the recording width of the photosensitive belt 10 and a resilient supporting member 31 supporting the tip 30. The resilient supporting member 31 is supported by a printer body through a holder 32 at one end. The elastically deformable tip 30 has an elastic edge portion 30*a* of a substantially triangular section profile and a resilient leg portion 30*b* extending almost in parallel with the photosensitive belt 10. The other end portion of the plate-like resilient supporting member 31 is buried in the resilient leg portion 30*b* along its entire length. The elastic tip 30 is constituted by a rubbery resilient material such as urethane rubber, nitrile rubber, neoprene rubber, silicon rubber, natural rubber, or the like. An elastic material having a rubber hardness (JIS) in a range of 30° to 90° is preferably used. The edge 30*c* of elastic edge portion 30 to be contacted with the photosensitive belt 10 is an edge of 90° defined by two faces 30*d* and 30*e*. An angle $\theta_1$ defined between the rearward face as viewed in the running direction of the photosensitve belt 10 from the cleaning line 30*c* and the face 30*d* of the elastic tip 30 is set at 67°, while an angle $\theta_2$ defined between the face on the forward side of the photosensitive belt 10 and the face 30*e* of the elastic tip is set at 23°. The edge 30*c* is projected toward the photosensitive belt 10 apart from the longitudinal axis of the resilient leg portion 30*b*.

The resilient supporting member 31 is made of a resilient sheet material such as a phosphor bronze plate, a stainless plate or a resilient plastic plate. While one end of the resilient supporting member 31 is secured to the holder 32, it extends substantially in parallel with the photosensitive belt 10 from the rearward side to the forward side in the running direction thereof. The elastic tip 30 is attached to the other end of the resilient supporting member 31. Therefore, the cleaning blade is supported on the forward side of the cleaning line 30*c* of the photosensitive belt 10. The holder 32 is located and fixed at a predetermined location orthogonal to the image-forming face of the photosensitive belt 10. The edge 30*c* of the elastic tip 30 is press contacted with the photosensitive belt 10 by utilizing a resilient restoring force developed in the resilient leg portion 30*b* and the resilient supporting member 31 in a direction of an arrow "c". Since the restraint plate 19 is opposed to the elastic tip 30 on the opposite side of the photosensitive belt 10, the running photosensitive belt 10 is located and restrained in a position orthogonal to the running direction thereof by the restraint plate 19, so that the tip edge 30*c* of the elastic edge portion 30*a* is press contacted with the image-forming surface of the running photosensitive belt 10. As a result, the residual toner attached to the image-forming surface of the photosensitive belt 10 is scraped off by the tip edge portion 30*a* of the elastic tip 30. The scraped toner collects at the face 30*d* of the elastic edge portion 30*a*. However, an an amount of the collecting toner increases, the toner gradually moves on the face 30*d* in a direction leaving the photosensitive belt and finally falls in the housing 20. In this way, since the cleaning blade is supported on the forward side of the cleaning line, the scraped toner is speedily discharged even in the case that the photosensitive belt 10 runs downwardly in a vertical direction. In particular, if the cleaning blade which extends in the parallel with the running photosensitive belt is supported at the rearward side, the scraped toner is accumulated between the photosensitive belt and the cleaning blade to cause an unfavorable result.

FIGS. 3*a* and 3*b* are views illustrating the state in which the cleaning blade is contacted with the surface of the running photosensitive belt. First, when the cleaning blade is to be set, the elastic edge portion 30*a* is slightly pushed against the photosensitive belt 10, and the edge 30*c* is press contacted with the photosensitive belt 10 by utilizing the resilient restoring force of the edge portion 30*a*, the resilient leg portion 30*b* and the resilient supporting member 31. At that time, such a magnitude of the press contact force is sufficient that can produce an appropriate frictional force F between the photosensitive belt 10 and the edge 30*c*. Thus, the edge portion can be press contacted with the photosensitive belt by utilizing mainly the resilient restoring force developed in the elastic edge portion 30*a* so that bending amounts of the resilient leg portion 30*b* and the resilient supporting member 31 can be reduced. In this state, when the photosensitive belt 10 is run in the arrow "a" direction. The frictional force F determined by a coefficient of friction between the elastic deformable edge portion 30*a* and the surface of the photosensitive member acts upon the edge 30*c* together with the press contact force acting thereon. On the other hand, while the edge 30*c* projects toward the photosensitive belt by a distant "d" relative to the longitudinal axis "l" of the resilient leg portion 30*b* and the resilient supporting member 31, the other end of the resilient supporting member 31 is fixed to the holder 32. Accordingly, the frictional force F acts upon the edge 30*c* as a moment for counterclockwise deplacing the resilient movable portion of the blade around a fixing point of the supporting member. Consequently, as shown in FIG. 3*b*, the elastic edge portion 30*a*, the resilient leg portion 30*b* and the resilient supporting member 31 are slightly curved by this frictional force leaving from the photosensitive belt 10, so that a resilient bending force is stored mainly in the elastic leg portion 30*b* and the resilient supporting member due to this curving. This resilient bending force becomes the resilient restoring force to strongly press contact the edge 30*c* against the photosensitive belt 10. Since the residula toner is attached onto the photosensitive belt 10 by the electrostatic force, the push force which pushes the elastic edge portion 30*a* in the running direction of the photosensitive member acts when the residual toner contacts with the resilient edge portion. However, even when the push force acts upon the edge portion by the residual toner, the resilient leg portion 30*b* and the resilient support member 31 are bent to offset the push force of the residual toner and a greater resilient repulsion is stored to repulse the residual toner reversely in the running direction of the photosensitive member. Thereby, the residual toner can be effectively scraped off by the edge 30*c*, which is press contacted with the surface of the photosensitive belt.

The larger the coefficient of friction of the elastic rubbery material constituting the elastic edge portion is, the greater is a curved amount produced mainly in the resilient leg portion, while the smaller the rubber hardness, the larger the curved amount. Further, when a material easy to bend is used for the resilient supporting member, this curved amount becomes larger. Therefore, the rubbery material and the shape of the cleaning blade are appropriately selected so that it may be properly curved and displaced based on the coefficient of friction and the rubber hardness of the resilient rubbery material and the modulus of elasticity of the elastic material constituting the resilient leg portion. By so constructing, when the edge 30*c* is merely contacted with the surface of the photosensitive belt by a relatively weak press contact force, the edge 30*c* can be assuredly press contacted with the surface of the photosensitive member. Thus, the photosensitive belt is not damaged and the abrasion of the blade itself can be prevented. Further, since resilient leg portion and the resilient supporting member have only to be slightly bent on setting the blade, the blade-setting operation is made easy. In addition, since the resilient leg portion 30*b* and the resilient supporting member 31 are arranged in parallel with the running direction of the photosensitive belt, the cleaner box can advantageously be made narrower in the width direction thereof as compared with a case where a blade is set at a certain press contact angle.

In the illustrated embodiment, the angle $\theta_1$ defined between the face 30*d* with which the residual toner contacts and the photosensitive belt 10 is set at 67°. However, if $\theta_1$ is too small, the toner easily passes through the edge 30*c*, while if $\theta_1$ is too large, the strength of the resilient edge portion cannot be maintained. Thus, it is preferably that the angle $\theta_1$ is set at a range from 50° to 110°. The angle $\theta_2$ defined between the face 30*e* opposed to the photosensitive belt and the photosensitive belt is set at 23°. However, if $\theta_2$ is too large, the strength of the resilient edge portion 30*a* becomes lower. Thus, it is preferable that $\theta_2$ is set at a range from 7° to 45°.

FIG. 4 is a diagrammatical view illustrating a modification of the cleaner unit according to the present invention. In this embodiment, a photosensitive drum 40 in which a photosensitive member layer is formed on a surfce of a cylindrical Al substrate is used as an image-reproduction member, and a residual toner remaining on the photosensitive drum 40 is removed. A cleaning blade has the same construction as in the blade shown in FIG. 2. The blade 18 is arranged angularly relative to a tangential plane at a cleaning line of the photosensitive drum, and is fixed to a housing 41 of a cleaner box at the other end. As shown in FIG. 4, even when the cleaning blade is fitted at a press contact angle relative to the photosensitive drum, the resilient leg portion can be slightly curved away from the photosensitive drum by a frictional force acting upon the edge of the blade so that the residual toner can be effectively scraped off.

FIGS. 5*a* and 5*b* are sectional views illustrating modifications of the cleaning blade according to the present invention. Explanation is made while the same reference numerals are given to the same parts as used in FIG. 2. In FIGS. 5*a* and 5*b*, an elastic edge portion 50*a* and a resilient leg portion 50*b* of a cleaning blade 50 are integrally consituted by a rubbery elastic material, and an end of the resilient leg portion 50*b* is secured directly to a holder 32. As understoodf rom FIGS. 5*a* and 5*b*, a manufacturing cost can be lowered by integrally constituting the blade with the rubbery elastic material. Further, as shown in FIG. 5*b*, an angle of an edge 50*c* of the edge portion 50*a* may be acute smaller than 90°.

The present invention is not limited to the above-explained embodiments, but a variety of modifications and changes can be of course made. For instance, although the embodiments have been explained which are applied in the image-forming unit of the printer system, the cleaning apparatus according to the present invention is not limited to the printer system only, and can be applied to various kinds of image-reproduction apparatus such as copying machines, etc.

Finally, effects obtained by the above-explained invention are summarized as follows:

1. Since the edge constituting the cleaning line upon contact with the surface of the photosensitive belt projects toward the photosensitive belt apart from the central axis of the resilient leg portion, the resilient leg portion is curved and displaced in a direction leaving the photosensitive belt by the frictional force acting upon the edge, and a resilient repulsion is stored by the curving and displacement. When the residual toner contacts with the edge, the push force acts upon the blade from the toner along the running direction of the photosensitive belt. At that time, mainly the resilient leg portion is further curved owing to the push force of the residual toner, so that the greater resilient repulsion is stored to repulse the residual toner reversely in the running direction of the photosensitive belt. Thus, the residual toner can be effectively scraped off from the surface of the photosensitive belt by the resilient repulsion.

2. When the cleaning blade is set, the resilient leg portion can be curved and displaced owing to the effective frictional force which is produced merely by lightly pushed the blade against the photosensitive belt. Therefore, the press contact force acting upon the edge portion can be lowered so that the abrasion of the photosensitive member and the blade can be reduced. In particular, a press contact release mechanism for the blade is made unnecessary.

3. When the blade is set, it is almost unnecessary to curve the blade itself, and the edge portion has only to be slightly pushed against the photosensitive. Thus, the blade-setting operation is facilitated.

4. Since the resilient leg portión is supported substantially in parallel with the running direction of the photosensitive belt, the press contact force can be substantially vertically exerted upon the surface of the photosensitive belt. Thus, the setting operation can be further facilitated.

5. Since the cleaning blade is supported on the forward side of the running direction of photosensitive belt, the scraped toner can be speedily removed without a large amount of the toner being collected. Particularly, since the recording papers need to be discharged outside the printer in the facedown state (the recording face is directed downwardly), it is preferable to effect the transferring step at the vertical top side of the image-reproduction unit. In this case, since the cleaner unit is required to be arranged in a location where the photosensitive member runs vertically from the upper side to the lower side, to support the cleaning blade forward in the running direction of the charge image retentive member is extremely favorable for removing the scraped toner.

What is claimed is:

1. A cleaning apparatus for removing residual toner from a rotatable charge image retentive member, comprising an elastic cleaning blade for scraping residual toner from a recording region of said charge image retentive member, said elastic cleaning blade having a resilient leg portion and an elastically deformable cleaning edge projecting outward from said leg portion and toward said charge image retentive member, said cleaning edge being operative to be brought into contact with said charge image retentive member, and an elastic supporting member for supporting said leg portion at a downstream position relative to the rotational direction of said charge image retentive member, said leg portion being caused to curve away from said charge image retentive member while maintaining said cleaning edge in contact with said charge image retentive member when a frictional force is applied to said cleaning edge by the rotation of said charge image retentive member.

2. The cleaning apparatus of claim 1 wherein said leg portion and said cleaning edge are integral portions of said elastic cleaning blade and are made from a rubbery elastic material.

3. The cleaning apparatus of claim 1 wherein said supporting member is made of a resilient sheet metal.

4. The cleaning apparatus of claim 1 wherein said elastic cleaning blade is made from a rubbery elastic material, said leg portion and said cleaning edge are integral portions of said elastic cleaning blade, said supporting member is made from a resilient sheet metal, and a portion of said supporting member is within said elastic cleaning blade.

5. The cleaning apparatus of claim 1 wherein said cleaning edge is substantially triangular in cross-section.

6. The cleaning apparatus of claim 5 wherein an angle in the range of about 50° to 110° is formed between an upper portion of said cleaning edge and said charge image retentive member, and an angle in the range of about 7° and 45° is formed between a lower portion of said cleaning edge and said charge image retentive member.

7. The cleaning apparatus of claim 1 wherein said leg portion extends substantially parallel to a moving direction of said charge image retentive member.

8. A cleaning apparatus for removing residual toner from a rotatable charge image retentive member, comprising an elastic cleaning blade for scraping residual toner from a recording region of said charge image retentive member, said elastic cleaning blade including a resilient leg portion and an elastically deformable cleaning edge, said cleaning edge projection outwardly from said leg portion and toward said charge image retentive member, said cleaning edge being operative to be brought into contact with said charge image retentive member, said elastic cleaning blade being supported at a position located downstream relative to the rotational direction of said charge image retentive member, said leg portion being cause to curve away from said charge image retentive member while said cleaning edge is maintained in contact with said charge image retentive member when a frictional force is applied to said cleaning edge by the rotation of said charge image retentive member.

9. The cleaning apparatus of claim 8 wherein said leg portion and said cleaning edge are integral portions of said elastic cleaning blade.

10. The cleaning apparatus of claim 8 wherein said elastic cleaning blade is made from a rubbery elastic material, and said leg portion and cleaning edge are integral portions of said elastic cleaning blade.

11. The cleaning apparatus of claim 8 wherein said cleaning edge is substantially triangular in cross-section.

12. The cleaning apparatus of claim 8 wherein an angle in the range of about 50° to 110° is formed between an upper portion of said cleaning edge and said charge image retentive member, and an angle in the range of about 7° and 45° is formed between a lower portion of said cleaning edge and said charge image retentive member.

13. The cleaning apparatus of claim 8 wherein said leg portion extends substantially parallel to a moving direction of said charge image retentive member.

14. In combination, a rotatable charge image retentive member, and an elastic cleaning blade for scraping residual toner from a recording region of said charge image retentive member, said elastic cleaning blade having a resilient leg portion and an elastically deformable cleaning edge projecting outwardly from said leg portion and toward said charge image retentive member, said cleaning edge being operative to be brought in contact with said charge image retentive member, said elastic cleaning blade being supported at a position downstream relative to the rotational direction of said charge image retentive member, said elastic cleaning blade being aligned relative to said charge image retentive member so that said leg portion is caused to curve away from said charge image retentive member while said cleaning edge is maintained in contact with said charge image retentive member when a frictional force is applied to said cleaning edge by the rotation of said charge image retentive member.

15. The combination of claim 14 further comprising an elastic supporting member for supporting said cleaning blade at said downstream position.

16. The cleaning apparatus of claim 15 wherein said charge image retentive member is a photoconductive belt.

17. The cleaning apparatus of claim 14 wherein said leg portion and said cleaning edge are integral portions of said elastic cleaning blade and are made from a rubbery elastic material.

18. The cleaning apparatus of claim 15 wherein said supporting member is made from a resilient sheet metal.

19. The cleaning apparatus of claim 15 wherein said elastic cleaning blade is made from a rubbery elastic material, said leg portion and said cleaning edge are integral portions of said elastic cleaning blade, said supporting member is made from a resilient sheet metal, and a portion of said support member is within said elastic cleaning blade.

20. The cleaning apparatus of claim 14 wherein said cleaning edge is substantially triangular in cross-section.

21. The cleaning apparatus of claim 14 wherein an angle in the range of about 50° to 110° is formed between an upper portion of said cleaning edge and said charge image retentive member, and an angle in the range of about 7° and 45° is formed between a lower portion of said cleaning edge and said charge image retentive member.

22. The cleaning apparatus of claim 14 wherein said leg portion extends substantially parallel to a moving direction of said charge image retentive member.

* * * * *